US005998079A

United States Patent [19]

Thompson et al.

[11] Patent Number: 5,998,079

[45] Date of Patent: Dec. 7, 1999

[54] COLOR TONER

[75] Inventors: Richard J. Thompson, Ohio Pyle; Mark J. Winfield, Jeannette; Christopher A. Povirk, Alverton, all of Pa.

[73] Assignee: International Communication Materials, Inc., Connellsville, Pa.

[21] Appl. No.: 09/074,045

[22] Filed: May 7, 1998

[51] Int. Cl.[6] ..... G03G 9/099

[52] U.S. Cl. ..... 430/110; 430/106; 430/109

[58] Field of Search ..... 430/110, 106, 430/109

[56] References Cited

U.S. PATENT DOCUMENTS

| | | | |
|---|---|---|---|
| 4,623,605 | 11/1986 | Kato et al. | 430/110 |
| 4,652,509 | 3/1987 | Shirose et al. | 430/110 |
| 4,767,688 | 8/1988 | Hashimoto et al. . | |
| 4,845,003 | 7/1989 | Kiriu et al. | 430/110 |
| 5,138,089 | 8/1992 | Ong et al. . | |
| 5,166,026 | 11/1992 | Fuller et al. . | |
| 5,188,929 | 2/1993 | Ishii . | |
| 5,202,209 | 4/1993 | Winnik et al. . | |
| 5,256,515 | 10/1993 | Law et al. . | |
| 5,275,900 | 1/1994 | Ong et al. . | |
| 5,300,387 | 4/1994 | Ong . | |
| 5,370,962 | 12/1994 | Anderson et al. | 430/110 |
| 5,385,798 | 1/1995 | Law et al. . | |
| 5,418,109 | 5/1995 | Kanakura et al. . | |
| 5,503,954 | 4/1996 | Maruta et al. . | |
| 5,518,852 | 5/1996 | Sukata et al. . | |
| 5,538,829 | 7/1996 | Ong et al. . | |
| 5,622,802 | 4/1997 | Demizu et al. . | |
| 5,637,427 | 6/1997 | Yamamoto et al. . | |
| 5,663,025 | 9/1997 | Ciccarelli et al. . | |
| 5,665,512 | 9/1997 | Tsutsui et al. . | |
| 5,714,294 | 2/1998 | Maruta et al. . | |
| 5,776,647 | 7/1998 | Kido et al. | 430/110 |
| 5,863,692 | 1/1999 | Nakamura et al. | 430/110 |

FOREIGN PATENT DOCUMENTS

| | | |
|---|---|---|
| 3-039973 | 2/1991 | Japan . |
| 10-268570 | 10/1998 | Japan . |

OTHER PUBLICATIONS

Diamond, Arthur S. (ed.) Handbook of Imaging Materials. New York: Marcel–Dekker, Inc. p. 169. 1991.

Chemical Abstracts 115: 102882. 1991.

Chemical Abstracts 129:337626. 1998.

*Primary Examiner*—Christopher D. Rodee

*Attorney, Agent, or Firm*—Fay, Sharpe, Fagan, Minnich & McKee, LLP

[57] ABSTRACT

The invention relates to a color toner composition comprising at least a binder resin and a colorant, and further comprising at least two charge control agents, wherein at least one of said charge control agents is a boron-containing compound, and at least two post-additive compounds used to treat the surface of said color toner.

36 Claims, 1 Drawing Sheet

COLOR TONER

The invention relates to a color toner composition for use in developing an electrostatic image by electrophotographic, electrostatic recording and printing processes.

BACKGROUND OF THE ART

Present day toners are formulated from a range of potential components. Most toner compositions include at least a polymeric binder material and a colorant. Other commonly used components include black and colored magnetic oxides, charge control agents, internal additives to augment toner properties, such as aiding in deagglomeration and homogeneous distribution of the colorant in the toner composition, and external additives, to aid in the proper function of the toner. The components used in a particular toner formulation are dependent on the requirements of the machine in which the toner will be used. For instance, the toner formulation must take into account such parameters as image quality, reliability, carrier life, toner shelf life, etc., all of which are intricately involved with the mechanical capability and design of the hardware of the machine. Often, there is more than one component of a toner formulation which performs to eradicate certain undesirable properties of the toner. These same components may however, also contribute to other problems, or the combination of two or more components which affect the same toner properties may result in over-correction of a trouble area in the toner performance. Therefore, the combination of components selected to comprise a given toner composition must be carefully balanced, taking into account the full range of properties contributed by each component and the interaction of each component with every other component of the toner composition. The choice of components is further influenced by cost and other practical considerations.

The bulk polymeric material of the toner generally functions as the binder for the colorants included in the toner formulation, but also affects many of the other toner functions, such as charging, electrical resistivity, and mechanical integrity, to name a few. Therefore, often times a combination of resins is used to achieve the desired performance. Polymers used in toner may be linear, branched or cross linked, and are chosen for their properties with respect to: thermal performance, i.e., glass transition temperature, melt viscosity, blocking temperature, and thermal integrity; mechanical properties, i.e., impact strength, adhesive/cohesive strength, and surface energy; electrical traits, i.e., triboelectric charge function, resistivity, and dielectric constant; and other miscellaneous features, such as moisture resistivity, % volatility, molecular weight, colorlessness, and pigment compatibility.

Among the most popular resins from which the toner resin may be selected are: acrylic resins, epoxy resins, polyamide resins, polyester resins, polyethylene resins, polystyrene resins, styrene-acrylic copolymer resins, and styrene-butadiene resins.

Dispersed in the binder resin are the colorants used in the toner formulation. In monocomponent toners, magnetic oxide pigments are used for the purpose of enhancing the magnetic attraction between the toner and the developer roll assembly. Carbon black has historically been the most popular colorant used in black toners, as it strongly influences the triboelectric charging capability of the toner. However, more recent toners employ charge control agents to achieve and control this toner feature, thus allowing the use of more easily dispersed black colorants. The black colorant may also affect the flow characteristics of the toner and, therefore, is sometimes added in incremental amounts to the toner surface.

The use of charge control agents to affect charging and development has been known. Originally, the agents of choice were those comprising metal dye complexes. These materials, however, are high in cost, color, and often times may exhibit unacceptable toxicity levels. Charge reversal agents, most of which are negatively charged, became popular with use of the organic photoreceptor. The negative charge imparted generated a need to balance the overall charge on the toner/system. This need was addressed by the development of coated carrier materials, such as fluorocarbon-coated ferrite carriers. Also, and in combination with the coated carrier, it has been popular to use nitrogen containing nigrosine dyes. These dyes, however, not unlike the metal dye complexes, are highly colored and contribute to a host of other problems relating to uniformity and reproducibility in print, carrier contamination, and quality consistency. No one charge control agent is known which is suited for all machines, and in choosing an agent the technician must consider machine hardware, the carrier component characteristics, the polymer material characteristics, the colorants, and processing conditions. As was noted earlier, it is necessary to balance the properties of the various toner components when addressing these considerations.

Most toner formulations also include any one or more of a number of materials known commonly in the industry as additives. These are generally fine particles which are physically blended with the toner at up to about 3% of the composition. They may be attached to the toner by electrical means, mechanical means, or by mere physical mixing, though this is not generally the manner of choice. These additives may be added to influence flow control, charge control, cleaning, fixing, offset prevention, transfer, conductivity control, humidity sensitivity control, and carrier life stability. Common additive materials include silica, metal oxides, metal stearates, fluoro polymer powders, fine polymer powders, rare earth oxides, waxes, conductive particulates, magnetite, carbon, and titanates. Choice of additives is critical, however, given that many of the additives affect more than a single property.

Clearly, given the vast number of components available in the industry for use in toner compositions, and given the propensity for many of the components to enhance some properties and at the same time to deleteriously affect others, choice of components is clearly not a routine matter.

For example, it is known, as was set forth earlier, to produce toner compositions which include charge control agents, and even to produce toner compositions which include a combination of charge control agents. Further it is known to use agents which are metal complexes of certain acids. These compositions do not always, however, impart to the toner composition the appropriate or necessary charge level. It has remained for the current inventors to develop a toner composition including a charge control agent combination which desirably affects the resulting toner as it relates to performance in the machine in which it is intended to be used.

Also of concern, has been the choice of post additives used in toner formulations. The current inventors have also developed a combination of post additives, to be used as a surface treatment for toner compositions, which results in desirable toner performance.

The combination of these discoveries, though each alone is found to result in unexpected performance advantages, results in even greater benefits in use than the components impart individually.

SUMMARY OF THE INVENTION

It is therefore an abject of the present invention to provide a toner composition which exhibits enhanced performance with respect to background or fogging, and further with respect to image density and uniformity.

It is another object of this invention to provide a toner composition which includes a combination of components which desirable affect toner performance with respect to copy uniformity and triboelectric charge stability.

It is another object of this invention to provide a toner composition which includes a combination of charge control agents, wherein at least one of the agents used includes boron, to enhance the performance of the toner in use.

It is yet another object of the invention to provide a toner composition which includes a combination of post additives which desirably affect the performance of the toner is use.

It is yet another object of the invention to provide a toner composition which includes a combination of charge control agents, wherein at least one of the agents contains boron, and further includes a combination of post additives, the affect of the combination of both unique component combinations being enhanced toner performance.

These and other objects of the invention will become known to the skilled artisan by reading and practicing the invention as described and set forth in the disclosure which follows.

DETAILED DESCRIPTION OF THE INVENTION

Figure 1:
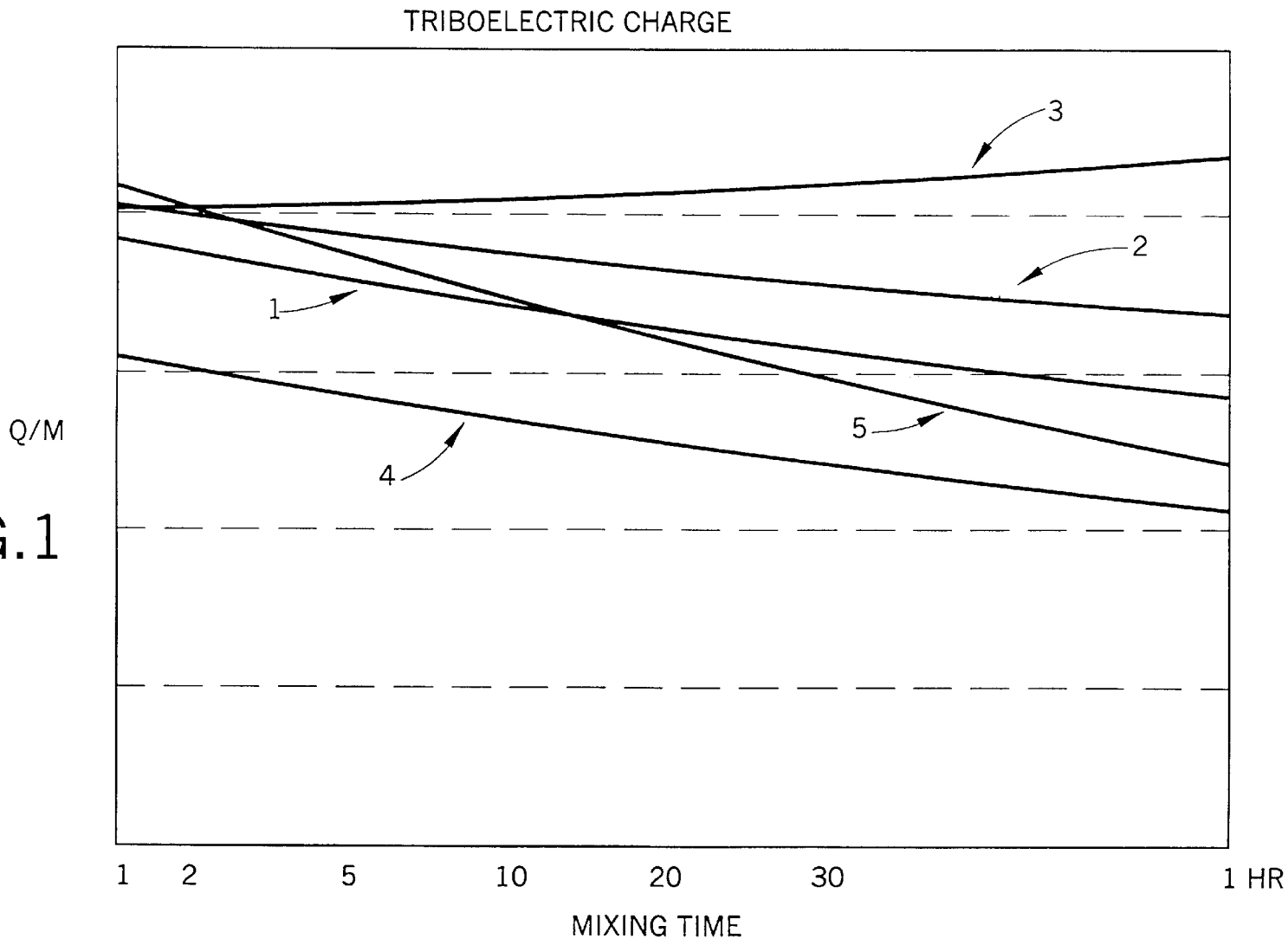
FIG. 1 represents a graph of triboelectric charge values for color toner.

The present invention is related to a toner for use in the printing and recording of images by electrophotographic and electrostatic processes. More particularly, the invention relates to the use of specific toner components the use of which results in the production of clear, sharp images. In various embodiments of the subject invention, there are provided toners and processes for the production and use thereof wherein the toner composition comprises a binder resin, a colorant, and several additives, including a combination of charge control agents, and a combination of post treatment additives.

Of particular importance to the toner which is the subject of the present invention is the use of a combination of charge control agents. Charge control agents are added to a toner for the purpose of making the toner product either more electronegative or more electropositive. Whether the toner needs to be made more electronegative or more electropositive is determined by several factors. Some of these include the electronegativity of the remaining toner components as combined, i.e., different colorants and resins may impart different charge characteristics to the toner composition. Also, the carrier, if one will be used, must be considered, as many carrier materials impart a charge to the toner composition. Further, the machine in which the toner is used may impart some charge to the toner, as will the operation thereof. The purpose of the charge control agent component of the toner is to stabilize the toner with respect to electrical charge and thus avoid problems of print quality, color balance, and fogging, which are associated with too much or too little charge on the toner particles.

Given the formulation which is the preferred embodiment of the subject invention, the charge control agent best suited to achieving suitably charged toner particles is, in fact, a combination of agents. Preferably both agents are negative charge control agents. One agent is preferably a boron containing complex of a dibenzo acetic acid, and the remaining charge control agent is selected from the group comprising metal complexes of salicylic acid compounds. Suitable metal complexes of salicylic acid to be used in combination with the boron complex agent include, for example, complexes containing zinc, chromium, molybdenum, aluminum, cobalt, iron, and nickel, though others may be used. The salicylic acid metal complexes of choice are further characterized by the presence of excess salicylic acid, i.e., up to 25% by weight of the mixture of metal complex and excess salicyclic acid. The boron complex used in practice of the subject invention may preferably be a boron dibenzo acetic acid compound comprising a borate bis-2-hydroxy 2,2 biphenyl acetate of the following structure:

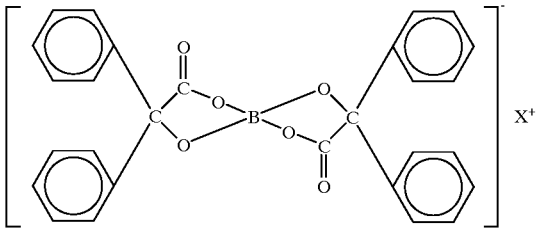

While the foregoing is particular to the toner formulation which is the preferred embodiment of the invention, other similarly suitable charge control agent combinations may be used for toners of varying formulation but within the scope of this disclosure.

Other internal additives, such as the aforementioned boron compound with C=, include S-34, S-40, E-82, E-81, E-84, E-87, E-88 and E-89, all manufactured by Orient Chemicals, and TRH, T-77, T-95, and TNS-2, all manufactured by Hodogaya Chemical Co. Charge control agents offered by BASF, Hoechst/Clariant, Zeneca and others may also be found to be suitable.

The toner of the present invention further includes external additives employed for the purpose of enhancing flowability of the toner product. The additive used may be a single component additive or may be a specific combination of additives, the combined use of which produces a special performance effect of the toner product.

Post additive treatment agents, such as flowability enhancers of the type used in this toner product, result in deagglomeration of the toner particles in use, and enhanced stability during storage of the toner product. In selecting a flowability enhancing additive to be added to the toner product during a post-treatment step, it is important to consider these parameters: anti-caking; flowability; electrostatic charge; stability; coefficient of friction; transfer efficiency; photoreceptor release properties; hydrophobicity; storage stability; and others. The indication of these characteristics generally requires inorganic compounds of fine particle size and high surface areas. These additives are often treated to render them hydrophobic in order to overcome the drawbacks associated therewith. Post-treatment additives of the type suggested for use in the preferred embodiment of the invention achieve the foregoing.

For example, as the post additive to be employed in production of a toner in keeping with the present invention there may be used a hydrophobic silica fine powder in combination with a hydrophobic titanium oxide powder. Preferably, the titanium oxide powder is a silane treated powder. Other suitable external additives, or post additives, may include but are not limited to the use of aluminum oxide; zinc oxide; cerium oxide; strontium titanate; iron oxide; ferrite powder; calcium carbonate; copper oxide; barium sulfate; lithopone; metal salts of fatty acids; powdered fluoropolymers, such as Kynar; polytetrafluoroethylene; polyethylene powder; carbon black; silicon carbide; silicon nitride; and powdered or fine particle polymers.

The toner composition further includes a binder resin which may be selected from any of a number of known resin compound compositions. Suitable resin components include polyamides, polyolefins, styrene acrylates, styrene methacrylates, styrene butadienes, cross linked styrene polymers, polyesters, cross linked polyester epoxies, polyurethanes, vinyl resins, including homopolymers or copolymers of two or more vinyl monomers; and polymeric esterification products of a dicarboxylic acid and a diol comprising diphenol. Vinyl monomers include styrene, p-chlorostyrene, unsaturated mono-olefins such as ethylene, propylene, buytlene, isobutylene, and the like; saturated mono-olefins such as vinyl acetate, vinyl propionate and vinyl butyrate; vinyl esters such as esters of monocarboxylic acids, including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide, mixtures thereof; and the like. Examples of specific thermoplastic toner resins include styrene butadiene copolymers with a styrene content of from about 70 to about 95 weight percent. Additionally, cross linked resins, including polymers, copolymers, and homopolymers of the aforementioned styrene polymers may be selected.

As one toner resin, there are selected the esterification products of a di-or poly-carboxylic acid and a diol comprising a diphenol. These resins are illustrated in U.S. Pat. No. 3,590,000, the disclosure of which is incorporated herein by reference. Other specific toner resins include styrene/methacrylate copolymers, and styrene/butadiene copolymers; suspension polymerized styrene butadienes; polyester resins obtained from the reaction of bisphenol A and propylene oxide followed by the reaction of the resulting product with fumaric acid; and branched polyester resins resulting from the reaction of dimethylerterphthalate, 1,3-butanediol, 1,2-propanediol, and pentaerythritol, styrene acrylates, and mixtures thereof. Also, waxes with a molecular weight of from about 1,000 to about 7,000, such as polyethylene, polypropylene, paraffin waxes, polyamide waxes and various natural waxes can be included in, or on the toner compositions as internal lubricants or fuser roll release agents. Further, reactive extruded polyesters can be selected as the toner resin.

The resin or resins are included in the toner composition disclosed herein in an amount of from about 75% to about 98% of the toner composition. Preferably the resin component is included as from about 90% to about 96% of the total toner composition.

The resin particles have a Tg of from about 50° C. to about 75° C. and an acid number below 30. The weight average molecular weight for the resin component should preferably be between about 10,000 and about 100,000.

As a preferred embodiment of the subject invention, a combination of polyester resin components is used. The combined resin system has a molecular weight between 15,000 and 80,000, wherein the resins employed are both linear polyesters and one is a high molecular weight polyester resin compound exhibiting a molecular weight of about 80,000 and the other is a lower molecular weight polyester resin compound, exhibiting a molecular weight of about 13,000. Suitable resins for use in combination as described herein include the following resins and other similar linear polyester compounds: Mitsubishi Rayon FC-900 or FC-611; Reichhold Fine Tone 382-ES, 382ES-HMW, 6694; Schenectady Chemicals HRJ-11362, HRJ-11364, HRJ-11365, HRJ-11367, HRJ-11439, HRJ-11440 and HRJ11441; and Filco PL 9305.

The colorant used in the toner may be any of the known pigments or dyes suitable for use in toner and developer compositions. Specifically, the colorant should be a pigment or dye suitable for use with the recited or suggested resin component, and also compatible with the remaining components of the toner composition. Examples of suitable pigments include organic pigments such as Pigment Red 122; Pigment Red 146; Pigment Blue 15-3; Pigment Yellow 14 and 17; and carbon black. The pigment should be included in an amount ranging from about 2% to about 10% by weight of the toner composition and should have an average particle size of about 0.1 micron to about 1.0 micron.

In that instance where a dye is used as the colorant of the toner composition, the dye may be selected from those dyes including azo and diazo dyes. The colorants should have an average particle size of about 0.1 microns to about 1.0 microns, and should exhibit, in general, good heat stability, compatibility with the remaining toner components, transparency, dispersability, light fastness and bleed resistance. The toner of the present invention may also include a combination of pigment and dye components, as desired and workable within the resin formulation.

DETAILED DESCRIPTION OF THE PREFERRED EMBODIMENT

As an example of a toner formulation in accord with the claimed invention, provided hereinafter is processing information and a formulation representative of a preferred embodiment of the toner composition, specifically the production regiment and formulation of a magenta toner composition.

For this magenta color toner, a pigment concentrate was prepared by co-blending 60 parts by weight of a high molecular weight polyester resin, and 40 parts by weight of the colorant components. In this instance, the colorant was Hostperm Pink E pigment. To this combination was added 0.40 parts by weight Aerosil R-812 hydrophobic silica fine powder to aid in deagglomeration and dispersing of the pigment particles within the resin system. This constituted a preblend concentrate which was then processed at elevated temperatures under optimum conditions on a Twin-Screw Compounder to produce a molten, homogeneous blend of resin and colorant.

This composition was then cooled, crushed and ground in a Fluid Energy Mill to an average particle size of about 10 microns. Of this particulate composition, 14.7% was then blended with the remaining toner components, which included the remaining amount of the high molecular weight polyester 382 HMW resin and the full amount of the 382 ES lower molecular weight polyester resin, as well as a combination of charge control agents which included a zinc salicylic acid complex known as Bontron E-84 and a boron bis 2 hydroxy diphenyl acetate complex known as LR 147. This mixture was blended in a Henschel blender. Processing was carried out at elevated temperature, between about 100° C. and 150° C., and under optimum mixer conditions to produce once again a molten, homogeneous composition which was then cooled, crushed and ground in a Fluid Energy Mill using compressed air to produce a fine powder of optimum uniform particle size and distribution.

The mean particle size by volume of a toner in keeping with this processing may range from 5 to 15 microns, as measured on a Coulter Multisizer, depending upon the application and the requirements of the imaging machine in which the toner will be used. The toner produced in this specific embodiment had an average particle size of about 9 microns. Preferably, the Fluid Energy Mill is operated to control not only the mean particle size but also the top side size or largest particles present at about 17 microns. This is accomplished by controlling the air flow and the Classifier Wheel speed of the integral coarse classifier. The resulting fine powder toner was passed through an Air Classifier to selectively remove the ultra-fine particles, usually those of 5 microns or smaller, which may be detrimental to the xerographic process.

The resulting toner powder, produced in accord with the foregoing, demonstrated a mean particle size of about 9 microns by volume as measured on a Coulter Multisizer and a distribution ranging from about 5 microns to about 17 microns, with about 85% of the particles by number being larger than 5 microns and with less than 1% of the particles by volume being larger than 17 microns.

The toner powder thus produced was then post treated by blending the powder, in a Henschel High Intensity Blender, with from about 0.4% by weight to about 1.1% by weight of a combination of post additives, preferably, 0.3% to 0.6% by weight hydrophobic silane treated silica fine powder and 0.1% to about 0.5% by weight hydrophobic silane treated titanium oxide powder. Treatment with this combination of post additives produced a toner powder with optimum flow properties for use in the intended printer/copier machine. Specifically, the angle of repose measured less than 25° and the triboelectric charging properties of the toner were as desired.

The use of the pigment preblend process is critical in the magenta toner prepared in accord with the subject invention for sufficient deagglomeration and predispersion of the colorants in the toner powder.

Proper performance of the toner is greatly affected by control of the electrical properties, i.e., the combination of charge control agents used is important to the toner performance. This property was checked during compounding to monitor the dissipation factor using an RLC Bridge. The dissipation factor should be less than 0.0040, and preferably should be less than 0.0030.

The melt flow, or rheology, properties of the toner are also important, particularly with respect to the proper fixing of the toner image. Proper fixing of the toner is related to achieving good transparency and proper blending of the color toners in process color xerography. A proper balance of resin components, as described herein, helps to achieve the desired rheology.

EXAMPLE 1

In this Example 1, a color toner was prepared in accord with the foregoing process parameters. The binder resin used in this toner was a mixture of high molecular weight linear polyester and a lower molecular weight liner polyester. The binder comprised about 79.8% of the toner composition by weight. The colorant was Red 122. The charge control agent used comprised Hoechst Copylevel and a zinc salicylic acid complex. To this toner material was added a combination of post-additive agents used to enhance flow control. The agents used comprised a hydrophobic silane fine powder and a hydrophobic titanium dioxide fine powder.

This toner exhibited low print density and a high, unstable triboelectric value.

EXAMPLE 2

The toner of this Example 2 was prepared in accord with the toner described above as Example 1, except that a single zinc salicylic acid charge control agent was included. This toner exhibited low print density, fogging and a high, unstable triboelectric value.

EXAMPLE 3

In Example 3, the toner was prepared in accord with that of Example 1, but differed in that it contained a single zinc salicylic acid charge control agent, and further contained only one post additive agent, a hydrophobic silica fine powder. When tested in use, this toner demonstrated low print density, fogging, and a high unstable triboelectric value.

EXAMPLE 4

The toner of this Example 4, prepared in accord with Example 1, contained only a single boron dibenzo acetic acid complex charge control agent. The print density exhibited by this toner was high and the triboelectric value low.

EXAMPLE 5

This toner composition included a combination of negative charge control agents, one of which was a boron dibenzo acetic acid complex, in keeping with the invention which is the subject hereof the invention, and also a combination of hydrophobic silica and hydrophobic titanium oxide post additives. The toner performed well in all evaluations.

Table 1, which follows, sets forth the resin content, charge control agent content, and post additive content for the toners of Examples 1–5, and further compares the performance of each toner when evaluated with respect to density, fogging, and triboelectric value. From this comparison an overall print rating was determined.

TABLE 1

Comparative Results

| Formulation | | | | | Performance | | | |
|---|---|---|---|---|---|---|---|---|
| Example | Polyester Resin | Pigment Concentration | Post Additive | CCA | Density | Fogging | Relative Triboelectric Values | Print Rating |
| 1 | 78.9 | 14.7 Red 122 | R-812 T-805 | E-84 Hoechst Copylevel | Low | Good | High Unstable | Unacceptable |
| 2 | 84.2 | 14.7 Red 122 | R-812 T-805 | E-84 | Low | Not Acceptable | High Unstable | Unacceptable |
| 3 | 83.7 | 14.7 Red 122 | R-812 | E-84 | Low | Not Acceptable | High Unstable | Unacceptable |
| 4 | 83.7 | 14.7 Red 122 | R-812 T-805 | LR-147 | High | Good | Low | Unacceptable |
| 5 | 83.2 | 14.7 Red 122 | R-812 T-805 | E-84 LR-147 | Good | Good | Good | Acceptable |

Clearly the toner of Example 5 containing a combination of negative charge control agents and a combination of hydrophobic post additive agents, performed in a superior manner. For example, the use of a single charge control agent, as demonstrated in Examples 2, 3 and 4 did not result in a toner composition with acceptable print density or triboelectric value. While the toner containing a zinc complex agent alone produced images with low print density, fogging, and unstable triboelectric values, the toner using a boron agent alone exhibited less fogging, high print density and low triboelectric value. Unexpectedly, the toner including both charge control agents exhibited good performance in all categories, though, given the result shown for Examples 2, 3 and 4, one might expect the combined agents to exhibit some of the same problems seen in those examples.

FIG. 1 represents a relative Q/M versus mixing time as measured by the blow-off method using a Faraday Cage, an electrometer to measure charge (Q) and an analytical balance to measure mass (M). The graph shows the Q/M versus mixing time of the various Examples 1 through 5 presented above.

The invention contemplated by this disclosure includes color toner formulations containing a combination of charge control agents wherein one agent is a boron complex and a combination of post additive agents. While the invention is shown to be well suited to the magenta toner exemplified, it is to be understood that the inventive aspects of the formulation as presented are equally applicable to all color toner formulations, and it is intended that the invention should be construed in keeping with and afforded the full breadth of coverage of the appended claims.

What we claim is:

1. A color toner composition comprising a toner powder comprising at least a binder resin, a colorant, and at least two charge control agents, wherein at least one of said charge control agents is a boron-containing complex of a dibenzo acetic acid compound and at least one other charge control agent is a metal complex of salicylic acid, the surface of said toner powder having been post-treated with at least two post-additive compounds.

2. The color toner composition of claim 1 wherein said at least two charge control agents comprise negative charge control agents.

3. The color toner composition of claim 1 wherein said metal complex of salicylic acid comprises a salicylic acid compound including a metal selected from the group consisting of zinc, chromium, molybdenum, aluminum, cobalt, iron, and nickel.

4. The color toner composition of claim 1 wherein said metal complex of salicylic acid comprises salicylic acid as up to about 25% by weight of said metal complex of salicylic acid.

5. The color toner composition of claim 1 wherein said binder resin is a combination of linear polyester resins and, based on weight average molecular weight, one of said resins is a high molecular weight polyester resin and the remaining resin is a low molecular weight polyester resin.

6. The color toner composition of claim 5 wherein said polyester resins are esterification products of di-carboxylic acid and a diol.

7. The color toner composition of claim 1 wherein said at least two post-additive compounds comprise hydrophobic fine particles of silica and titanium dioxide.

8. A magenta color toner composition comprising a toner powder comprising at least a binder resin, at least a magenta colorant, and at least two charge control agents, wherein at least one of said charge control agents is a boron-containing complex of a dibenzo acetic acid compound and at least one other charge control agent is a metal complex of salicylic acid, the surface of said toner powder having been post-treated with at least two post-additive compounds.

9. The magenta color toner composition of claim 8 wherein said at least two charge control agents comprise negative charge control agents.

10. The magenta color toner composition of claim 8 wherein said metal complex of salicylic acid comprises a salicylic acid compound including a metal selected from the group consisting of zinc, chromium, molybdenum, aluminum, cobalt, iron, and nickel.

11. The magenta color toner composition of claim 8 wherein said metal complex of salicylic acid comprises salicylic acid as up to about 25% by weight of said metal complex of salicylic acid.

12. The magenta color toner composition of claim 8 wherein said binder resin is a combination of linear polyester resins and, based on weight average molecular weight, one of said resins is a high molecular weight polyester resin and the remaining resin is a low molecular weight polyester resin.

13. The magenta color toner composition of claim 12 wherein said polyester resins are esterification products of di-carboxylic acid and a diol.

14. The magenta color toner composition of claim 8 wherein said at least two post-additive compounds comprise hydrophobic fine particles of silica and titanium dioxide.

15. A yellow color toner composition comprising a toner powder comprising at least a binder resin, at least a yellow colorant, and at least two charge control agents, wherein at least one of said charge control agents is a boron-containing complex of a dibenzo acetic acid compound and at least one other charge control agent is a metal complex of salicylic acid, the surface of said toner powder having been post-treated with at least two post-additive compounds.

16. The yellow color toner composition of claim 15 wherein said at least two charge control agents comprise negative charge control agents.

17. The yellow color toner composition of claim 15 wherein said metal complex of salicylic acid comprises a salicylic acid compound including a metal selected from the group consisting of zinc, chromium, molybdenum, aluminum, cobalt, iron, and nickel.

18. The yellow color toner composition of claim 15 wherein said metal complex of salicylic acid comprises salicylic acid as up to about 25% by weight of said metal complex of salicylic acid.

19. The yellow color toner composition of claim 15 wherein said binder resin is a combination of linear polyester resins and, based on weight average molecular weight, one of said resins is a high molecular weight polyester resin and the remaining resin is a low molecular weight polyester resin.

20. The yellow color toner composition of claim 19 wherein said polyester resins are esterification products of di-carboxylic acid and a diol.

21. The yellow color toner composition of claim 15 wherein said at least two post-additive compounds comprise hydrophobic fine particles of silica and titanium dioxide.

22. A cyan color toner composition comprising a toner powder comprising at least a binder resin, at least a cyan colorant, and at least two charge control agents, wherein at least one of said charge control agents is a boron-containing complex of a dibenzo acetic acid compound and at least one other charge control agent is a metal complex of salicylic acid, the surface of said toner powder having been post-treated with at least two post-additive compounds.

23. The cyan color toner composition of claim 22 wherein said at least two charge control agents comprise negative charge control agents.

24. The cyan color toner composition of claim 22 wherein said metal complex of salicylic acid comprises a salicylic acid compound including a metal selected from the group consisting of zinc, chromium, molybdenum, aluminum, cobalt, iron, and nickel.

25. The cyan color toner composition of claim 22 wherein said metal complex of salicylic acid comprises salicylic acid as up to about 25% by weight of said metal complex of salicylic acid.

26. The cyan color toner composition of claim 22 wherein said binder resin is a combination of linear polyester resins and, based on weight average molecular weight, one of said resins is a high molecular weight polyester resin and the remaining resin is a low molecular weight polyester resin.

27. The cyan color toner composition of claim 26 wherein said polyester resins are esterification products of di-carboxylic acid and a diol.

28. The cyan color toner composition of claim 22 wherein said at least two post-additive compounds comprise hydrophobic fine particles of silica and titanium dioxide.

29. A black color toner composition comprising a toner powder comprising at least a binder resin, at least a black colorant, and at least two charge control agents, wherein at least one of said charge control agents is a boron-containing complex of a dibenzo acetic acid compound and at least one other charge control agent is a metal complex of salicylic acid, the surface of said toner powder having been post-treated with at least two post-additive compounds.

30. The black color toner composition of claim 29 wherein said at least two charge control agents comprise negative charge control agents.

31. The black color toner composition of claim 29 wherein said metal complex of salicylic acid comprises a salicylic acid compound including a metal selected from the group consisting of zinc, chromium, molybdenum, aluminum, cobalt, iron, and nickel.

32. The black color toner composition of claim 29 wherein said metal complex of salicylic acid comprises salicylic acid as up to about 25% by weight of said metal complex of salicylic acid.

33. The black color toner composition of claim 29 wherein said binder resin is a combination of linear polyester resins and, based on weight average molecular weight, one of said resins is a high molecular weight polyester resin and the remaining resin is a low molecular weight polyester resin.

34. The black color toner composition of claim 33 wherein said polyester resins are esterification products of di-carboxylic acid and a diol.

35. The black color toner composition of claim 29 wherein said at least two post-additive compounds comprise hydrophobic fine particles of silica and titanium dioxide.

36. A color toner composition comprising a toner powder comprising a binder resin and a colorant, where said binder resin comprises a combination of linear polyester resins wherein, based on weight average molecular weight, one of said linear polyester resins is a low molecular weight resin and another of said linear polyester resins is a high molecular weight resin, and said toner powder further comprises a combination of negative charge control agents wherein at least one of said negative charge control agents is a boron-containing complex of a dibenzo acetic acid compound and at least one other of said negative charge control agent is a metal complex of salicylic acid, the surface of said toner powder having been post-treated with a combination of post additive agents wherein said post additive agents are hydrophobic in nature.

* * * * *